United States Patent [19]

Weaver

[11] 3,954,080

[45] May 4, 1976

[54] BOW MOUNT FOR TROLLING MOTORS

[75] Inventor: Lester C. Weaver, Fayetteville, Ark.

[73] Assignee: Shakespeare of Arkansas, Inc., Fayetteville, Ark.

[22] Filed: Feb. 13, 1975

[21] Appl. No.: 549,790

[52] U.S. Cl. ..... 115/17; 248/4

[51] Int. Cl.[2] ..... B63H 21/26

[58] Field of Search ..... 115/17, 18 R, 41 R; 248/4

[56] References Cited

UNITED STATES PATENTS

| | | | |
|---|---|---|---|
| 3,724,790 | 4/1973 | Harris et al. | 115/17 |
| 3,765,369 | 10/1973 | Henning | 115/17 |
| 3,861,628 | 1/1975 | Krieger | 115/17 |
| 3,874,318 | 4/1975 | Langley | 115/17 |
| R28,176 | 10/1974 | Horton | 115/17 |

*Primary Examiner*—Trygve M. Blix
*Assistant Examiner*—Stuart M. Goldstein
*Attorney, Agent, or Firm*—Hamilton, Renner & Kenner

[57] ABSTRACT

A linkage including a bracket for mounting a trolling motor on the bow or deck of a boat for swinging between operating and stowed positions. Releasable locking mechanism is provided for locking the motor in either position, and the release from one position and translation to the other position is accomplished by a single action on the part of the operator.

10 Claims, 16 Drawing Figures

FIG. 10
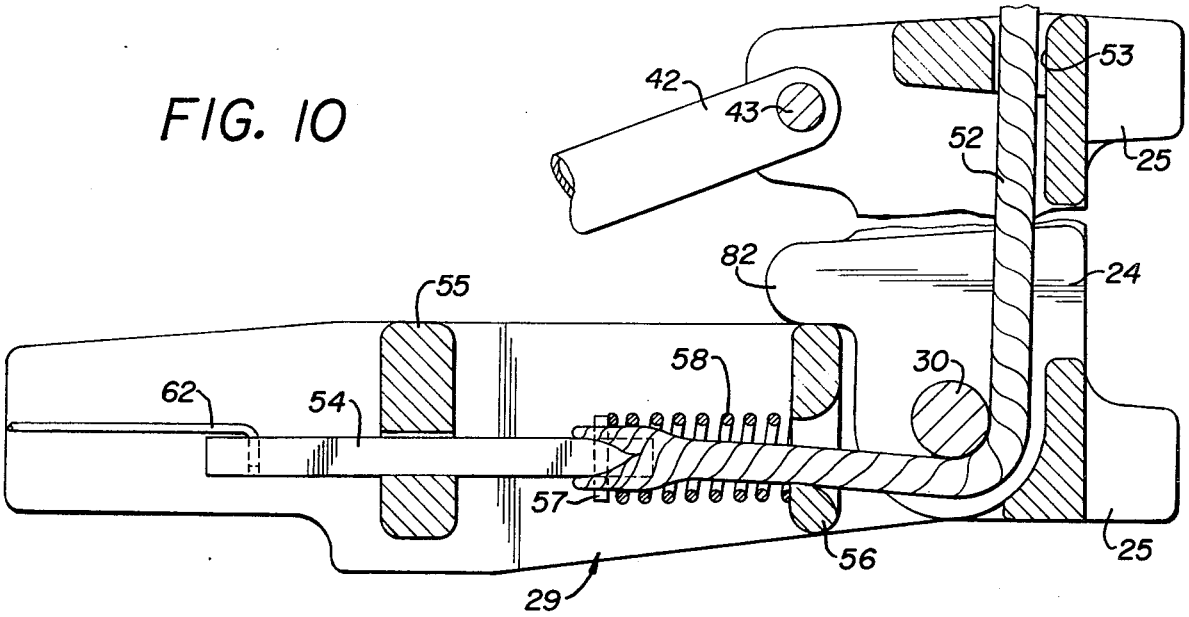
FIG. 11
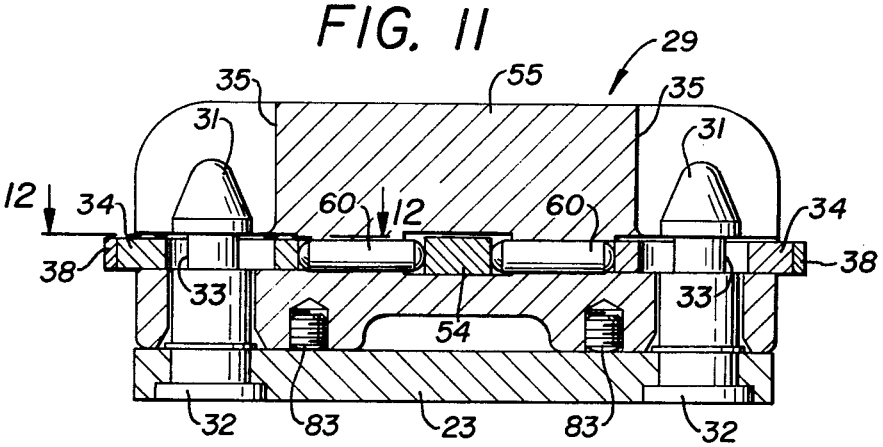
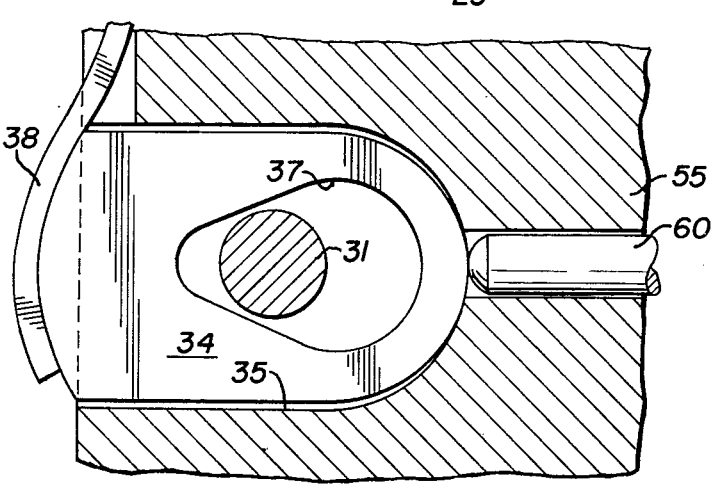
FIG. 12

BOW MOUNT FOR TROLLING MOTORS

BACKGROUND OF THE INVENTION

Prior known bow mounts for low horsepower trolling motors have been relatively complicated and expensive and have had several disadvantages in respect to ease of operation and stability in operating and stowing positions. U.S. Pat. No. Re. 28,176 discloses a bow mount having a linkage arrangement having some general similarity to the present construction but provides no means for positively locking and stabilizing the motor in operating and stowing positions. U.S. Pat. No. 3,765,369 discloses a bow mount having a swingable arm with locking means in the operating and stowing positions, but manual manipulation of separate means for adjusting the angularity of the motor with respect to the swing arm is required each time the motor is swung from one position to the other.

SUMMARY OF THE INVENTION

It is an object of the present invention to provide an improved bow mount construction for trolling motors which overcomes the disadvantages of prior constructions.

Another object is to provide an improved bow mount construction which is automatically locked when swung to operating position and when swung to stowed position.

A further object is to provide an improved bow mount construction which has means for stabilizing the motor in operating position.

Another object is to provide an improved bow mount in which the locking means in both the operating position and the stowed position is released by a single rope pull.

A still further object is to provide automatic locking means in the stowed position which moves out of the way in the operating position.

These and other objects are accomplished by the improvements comprising the present invention, a preferred embodiment of which is shown by way of example in the accompanying drawings and described in detail in the following specification. Various modifications and changes in details of construction are comprehended within the scope of the appended claims.

BRIEF DESCRIPTION OF THE DRAWINGS

FIG. 10 is a fragmentary sectional view on line 10—10 of FIG. 9.

FIG. 11 is a fragmentary sectional view on line 11—11 of FIG. 9.

FIG. 12 is an enlarged partial plan sectional view on line 12—12 of FIG. 11.

DESCRIPTION OF A PREFERRED EMBODIMENT

Figures 3, 15:
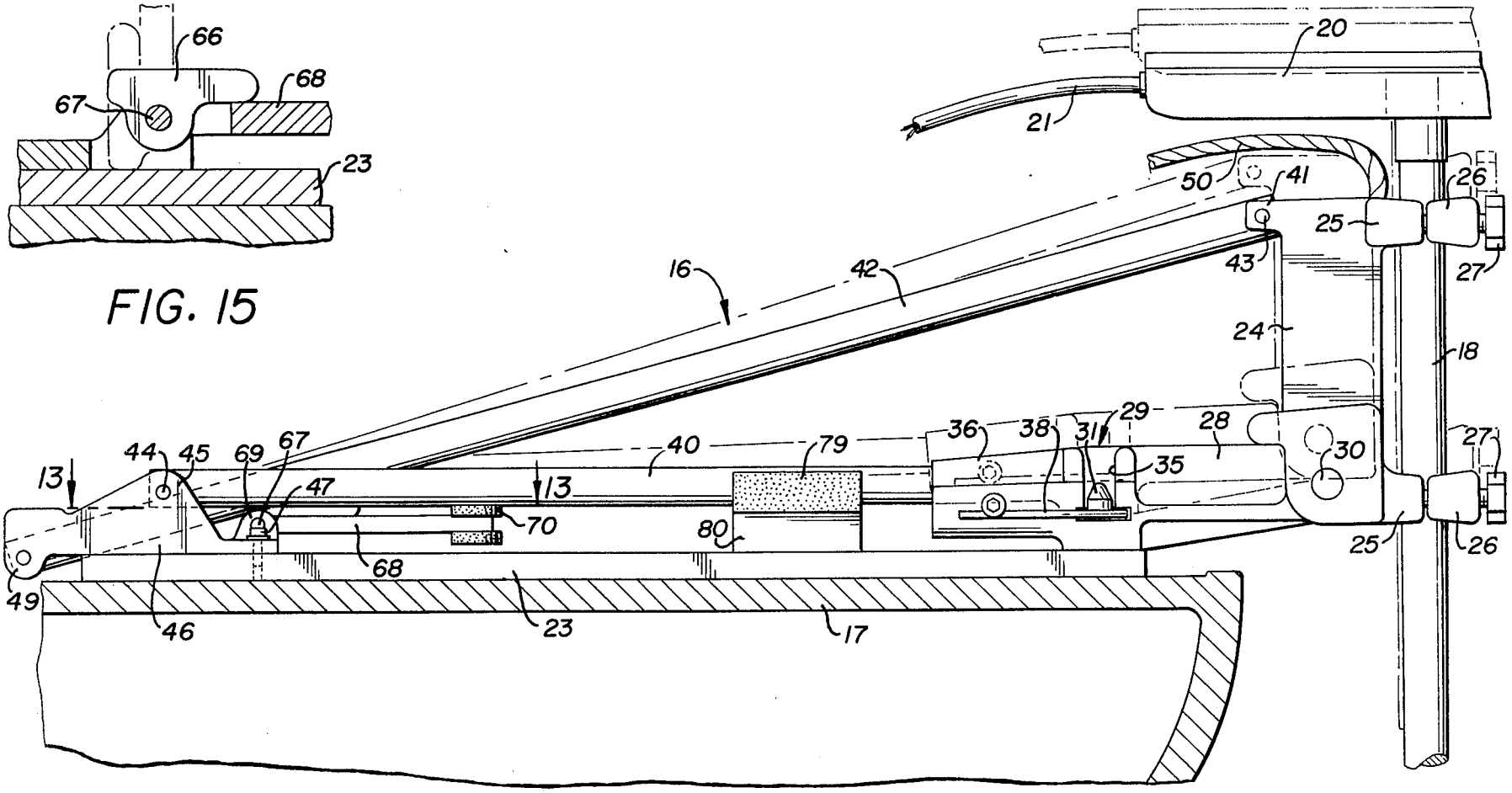
FIG. 3 is a side elevation thereof on line 3—3 of FIG. 2.
FIG. 15 is a fragmentary sectional view on line 15—15 of FIG. 13.
Figure 4:
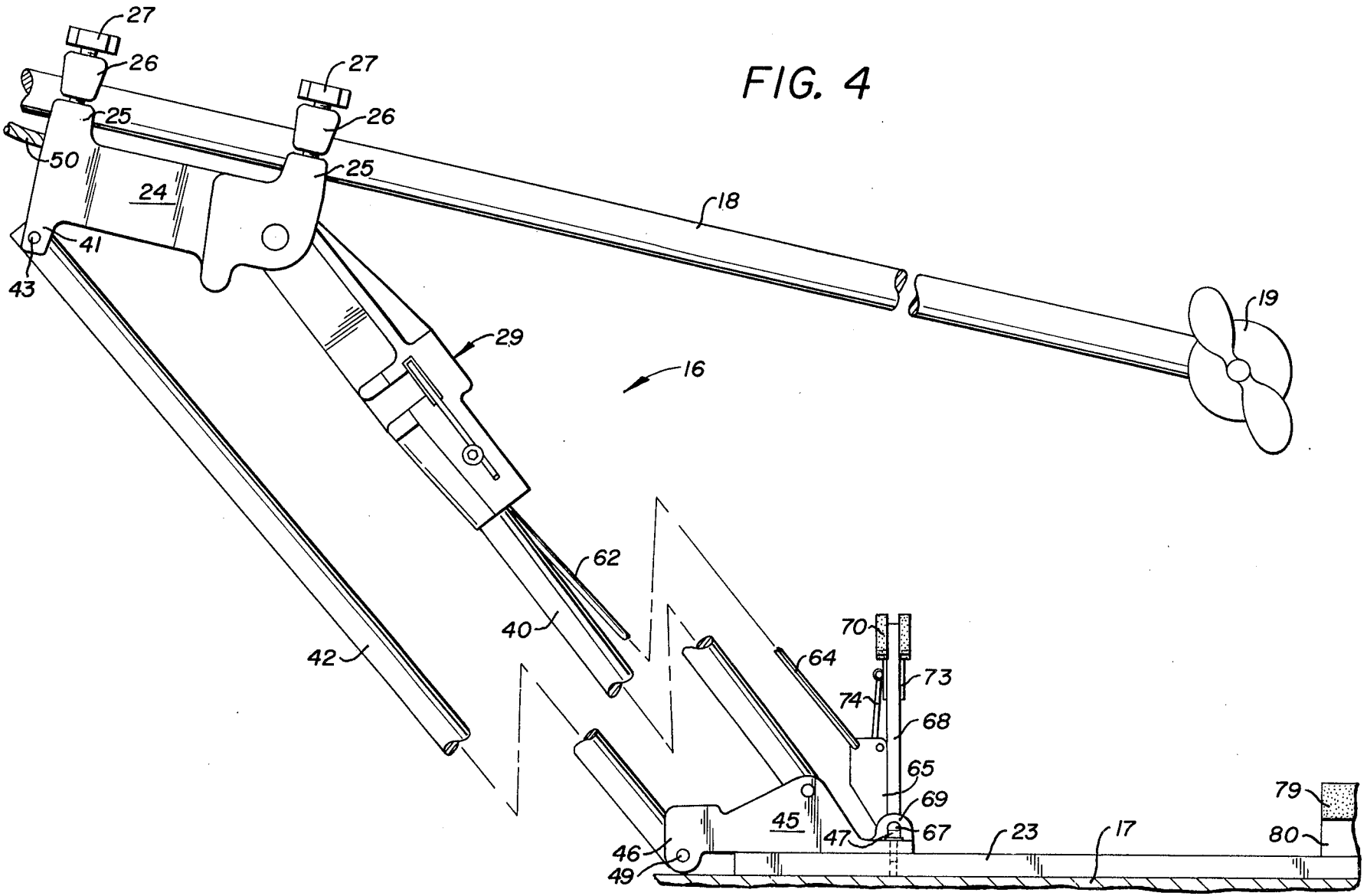
FIG. 4 is a side elevation showing the bow mount swung to an intermediate position (parts being broken away).

As best shown in FIGS. 3 and 4, the improved bow mount indicated generally at 16 is adapted to be supported on the deck 17 of the bow of a small boat, and is adapted to adjustably secure the motor tube 18 of a small horsepower submersible trolling motor 19 having an upper housing 20 enclosing the motor controls and the electrical connection with a cable 21 from a power source such as a battery (not shown). The boat is typically powered in the rear by a relatively high horsepower motor (not shown) which is usually mounted on the transom of the boat.

The bow mount includes a base plate 23 secured to the boat deck 17 by screws or the like and extending rearwardly from a point closely adjacent to the bow. A compound type of linkage is mounted on base plate 23 for swinging through an arc of 180°, and the linkage includes a mounting bracket 24 at its forward end in the operating position of the mount. The bracket 24 has spaced forwardly extending outer ears 25 which are recessed to receive the motor tube 18, and clamping bars 26 are provided to cooperate with ears 25 to adjustably clamp the motor tube 18 by means of thumb screws 27 for suspending the motor 19 at various depths. The motor tube may be a single tube or a conventional arrangement of concentric tubes, and the outer tube diameter may vary within conventional limits.

Figure 1:
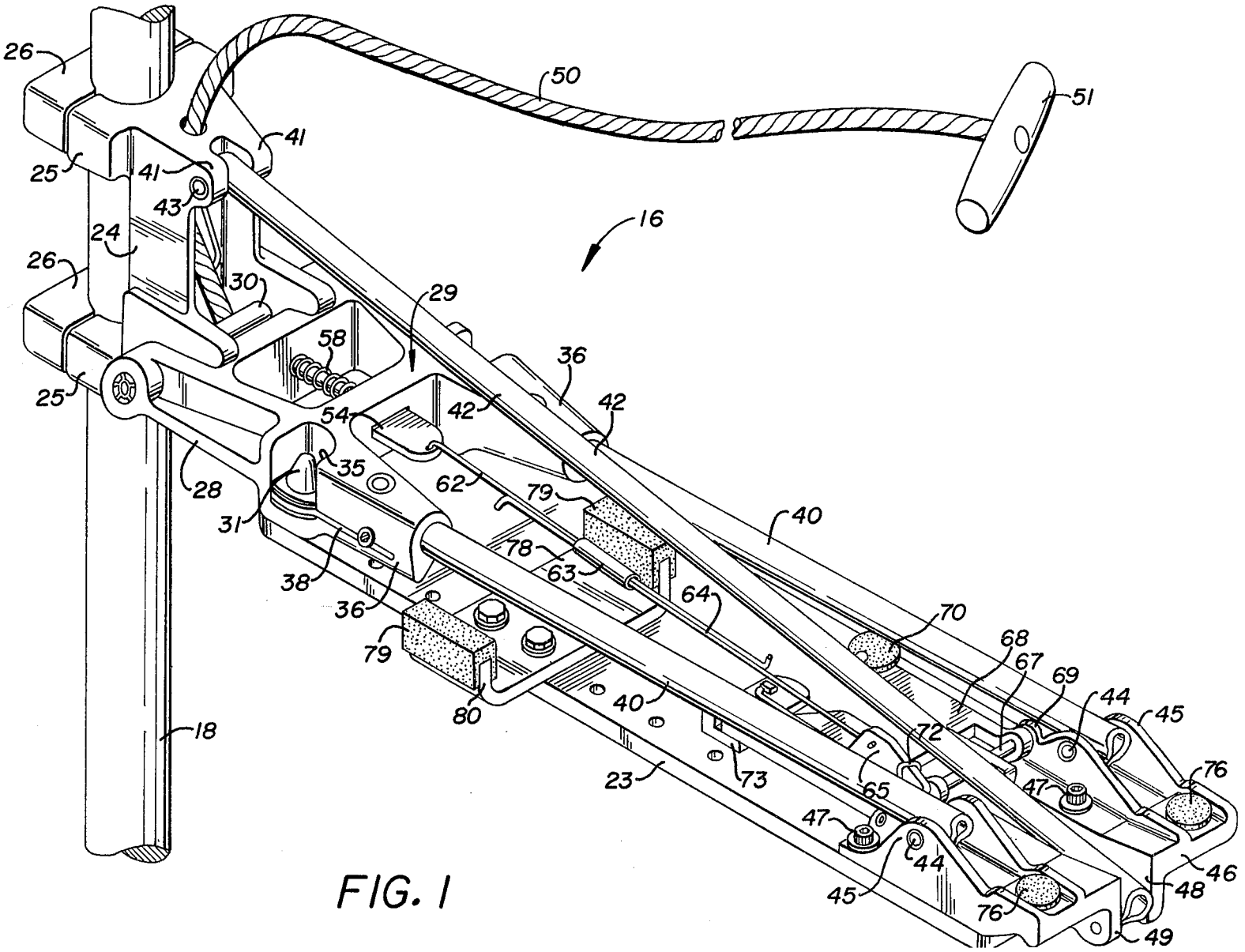
FIG. 1 is a perspective view of the improved bow mount construction with the motor tube in operating position.
Figures 2, 6, 7:
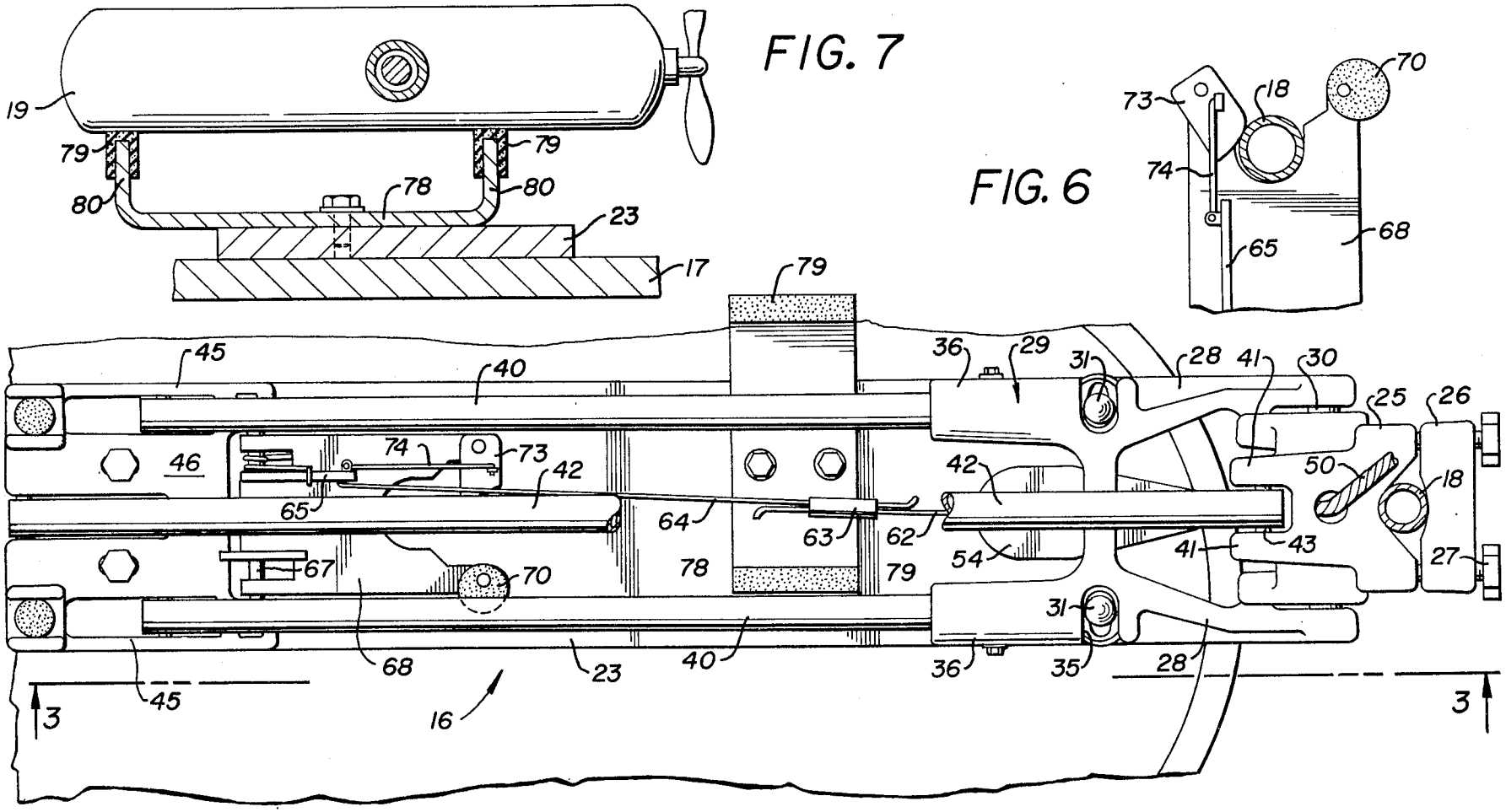
FIG. 2 is a partial plan sectional view thereof as secured on a boat deck at the bow.
FIG. 6 (on the same sheet as FIG. 2) is a partial vertical sectional view on line 6—6 of FIG. 5.
FIG. 7 (on the same sheet as FIG. 2) is a partial vertical sectional view on line 7—7 of FIG. 5A.

As viewed in FIGS. 1 – 3, the rearward or inner side of bracket 24 is swiveled at its lower end to the arms 28 of a yoke 29 by a pivot pin 30, and the yoke is detachably supported on the forward end of base plate 23. The means for detachably securing the yoke to the base plate preferably includes two laterally spaced conical headed latch pins 31 secured at their lower ends in the plate 23 by E-type retaining rings 32 (FIG. 11) and having annular recesses 33 under their heads to receive a pair of apertured latch plates 34. The conical heads of the latch pins 31 are located in recesses 35 in the sides of yoke 29 and the latch plates 34 are slidably received in the recesses 35. Tubular arms 36 on the yoke extend rearwardly of said recesses 35. As shown in FIG. 12, the apertures 37 in the latch plates are substantially pear-shaped and the smaller portions of the apertures are yieldingly held engaged in the annular recesses 33 by linear wire springs 38 pinned to the sides of the yoke arms 36 and abutting the outer edges of the latch plates, thus detachably securing the yoke 29 to the latch pins 31.

Referring again to FIGS. 1 – 3, rearwardly extending linkage bars 40 have their forward ends secured in the tubular yoke arms 36. The upper end of bracket 24 has a pair of rearwardly extending ears 41, and the forward end of a drag link bar 42 is pivotally connected between the ears 41 by a pivot pin 43. The opposite ends of linkage bars 40 are pivotally connected by pins 44 to upstanding ears 45 on a bracket plate 46 fixedly secured as by screws 47 to the rear end of the base plate 23. Preferably, the securing screws 47 are received in longitudinally slots in the base plate 23 to allow some adjustment of the plate 46 thereon. A medial groove 48 in the plate 46 receives the rear end of drag link bar 42 which is pivotally connected between depending ears 49 on opposite sides of the groove 48. Thus, the forward mounting bracket 24, the drag link 42 and the two linkage bars 40 pivotally connected between the bracket 24 and the rear bracket plate 46 can be considered as a compound linkage.

A rope 50 having a pull handle 51 on its outer end has its inner end portion 52 extending through an aperture 53 in the top of bracket 24 with its inner end connected to a wedge plate 54 movably mounted in the yoke 29, as best seen in FIG. 10. The wedge plate 54 is slidable in a rear cross bar 55 in the yoke and the portion 52 of the rope extends through an aperture in a front cross bar 56 of the yoke. The inner end of the rope is secured to the front end of wedge plate 54 by a pin 57 extending vertically through the front end of the plate. Preferably, the rope is of nylon braid construction and its inner end is formed into a self-retaining loop by folding the end back on itself and inserting it within the inner hollow formed by the braid. Then the braid of the exposed loop is separated to form two parts fitting over the ends of the pin 57 with the ends of the pin exposed. A helical spring 58 encircles the rope and is compressed between the pin 57 and the front cross bar 56. The spring confines the two loop end parts of the rope in engaged position with the pin 57.

Referring to FIGS. 8 – 12, when the motor is in operating position a pull on the rope 50 sufficient to move the wedge plate 54 forwardly and compress the spring 58 causes the tapered sides 59 of the wedge plate to slidably engage the rounded inner ends of two drive pins 60 which are laterally slidable in bores in the cross bar 55, thus moving the pins 60 outwardly to laterally displace the latch plates 34 against the inward pressure of springs 38. This displacement disengages the smaller portions of apertures 37 in latch plates 34 from the annular recesses in latch pins 31 so that a continued pull on the rope 50 will swing the yoke 29 upwardly over and above the latch pins.

Figure 9:
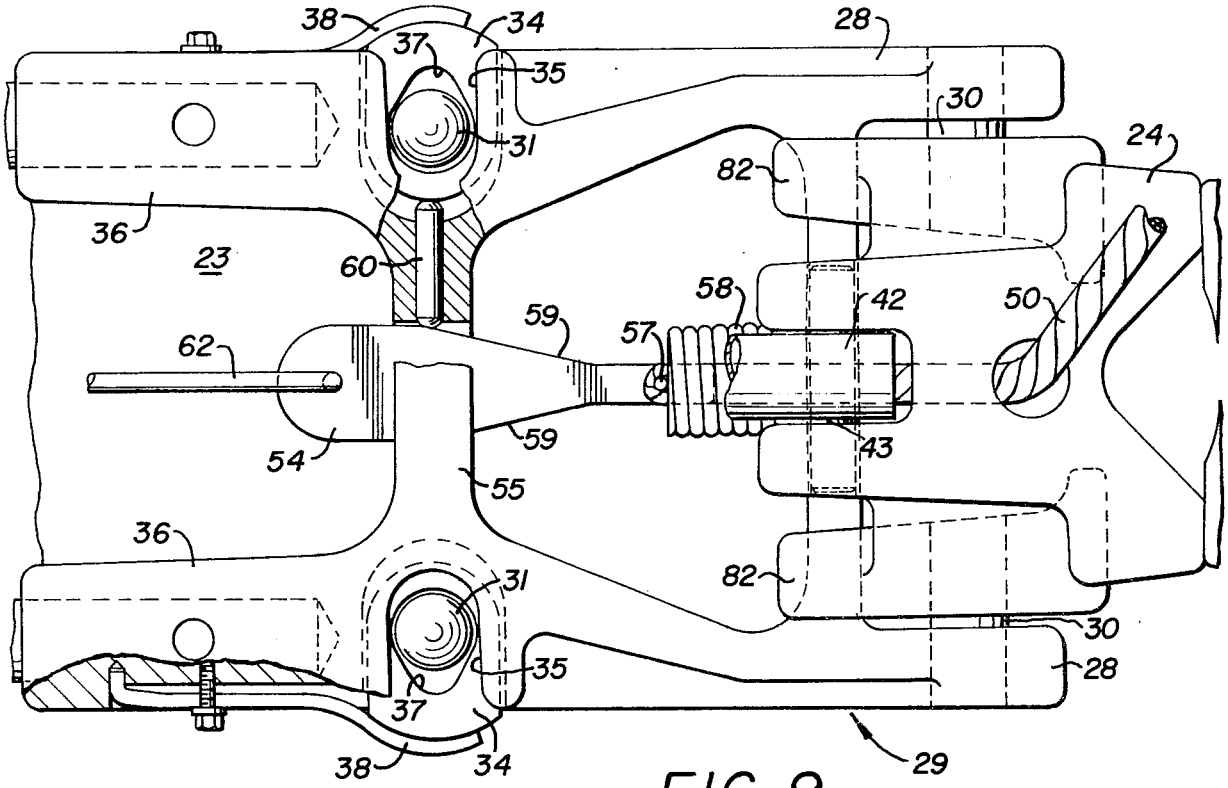
FIG. 9 is a similar view showing the locking means being released by the pull cord.
Figure 8:
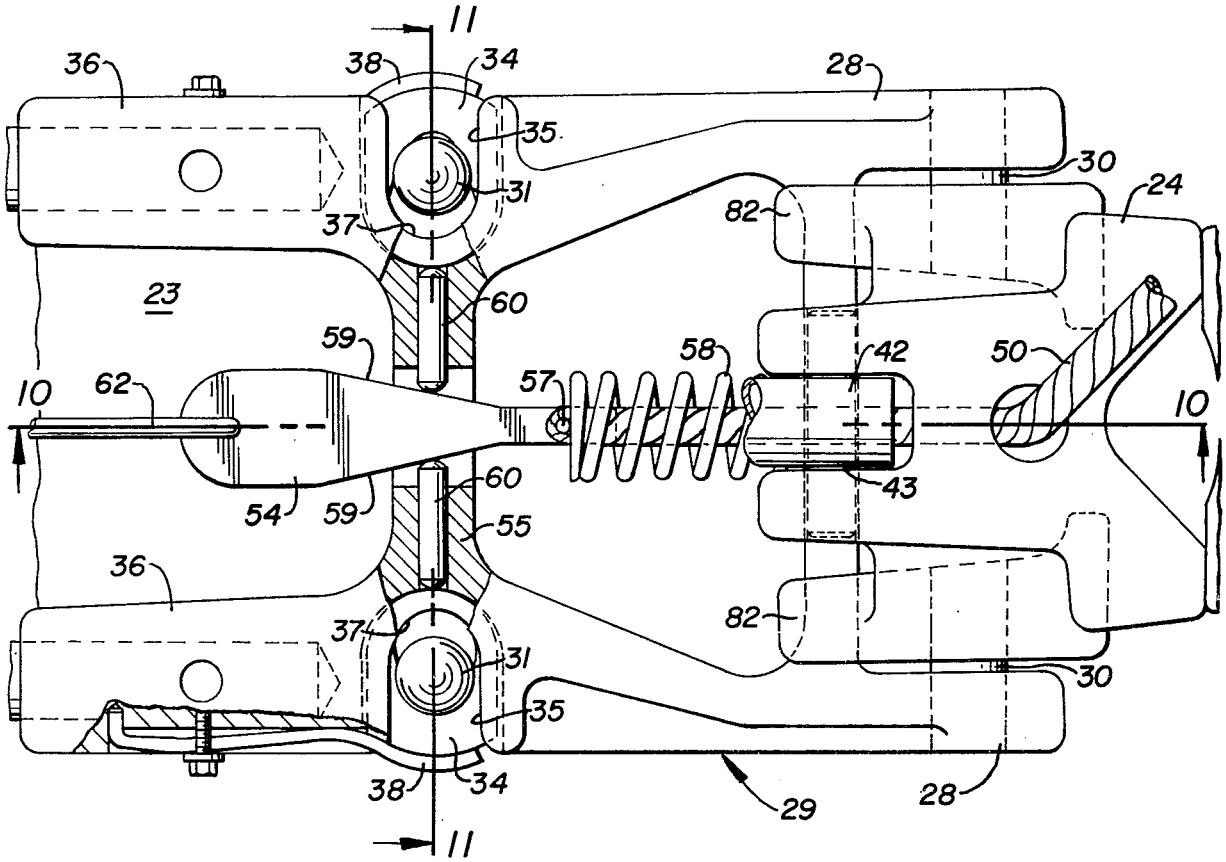
FIG. 8 is an enlarged partial plan view (parts being broken away and in section) similar to FIG. 2, showing the novel means locking the bow mount in operating position.

As indicated in FIG. 9, the forward motion of the wedge plate 54 is limited by a wire catch release link 62 which is connected at its front end to the rear end of the wedge plate. As seen in FIGS. 1, 2 and 4, the link 62 passes through a sleeve 63 and has a bent or upset rear end to engage the rear end of the sleeve as the link is pulled forwardly. The forward motion of the sleeve 63 is limited by engagement with the bent or upset front end of another link 64 passing through the sleeve and connected at its rear end with a catch release lever 65 pivotally mounted on the rear bracket plate 46, and, in the extended position of the wire links 62 and 64 (FIG. 5), a positive connection is provided between the wedge plate 54 and the lever 65.

The catch release lever 65 is pivoted on a catch pin 67 on which a catch frame 68 is pivoted, and the pin 67 is journaled in laterally spaced ears 69 on the front end of rear bracket plate 46. As shown in FIGS. 1 – 3 and

13, when the bow mount 16 is in position to support the motor in operating position, one of the link bars contacts a bumper pad 70 on the front corner of the frame 68 and holds it in substantially horizontal position. The pin 67 is encircled by a coil spring 71 which urges the frame toward an upright position and by a catch lever spring 72 which yieldingly urges the catch lever 65 against the catch frame 68. The frame is stopped in a vertical position by an arm 66 on the pin 67 engaging the base plate 23 (FIG. 15).

Figure 5:
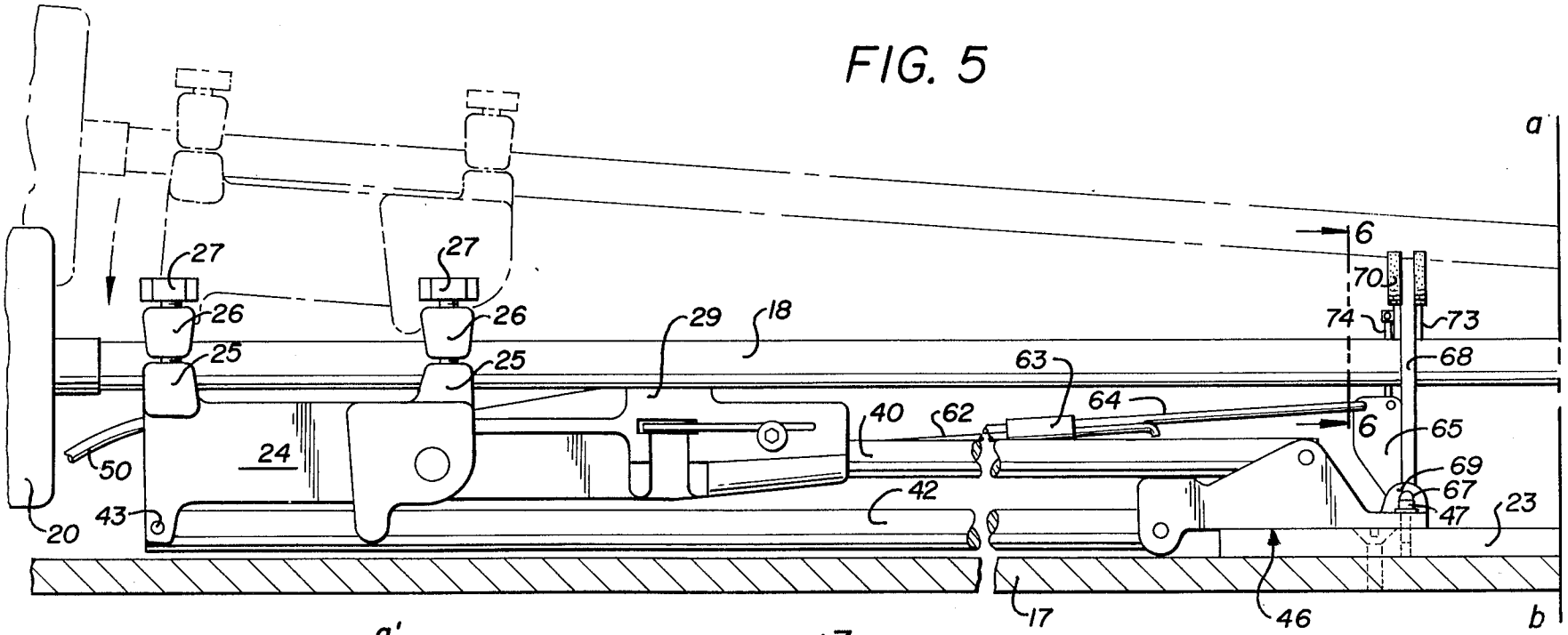
FIG. 5 is a partial side elevation showing the bow mount swung to stowed position.
Figure 13:
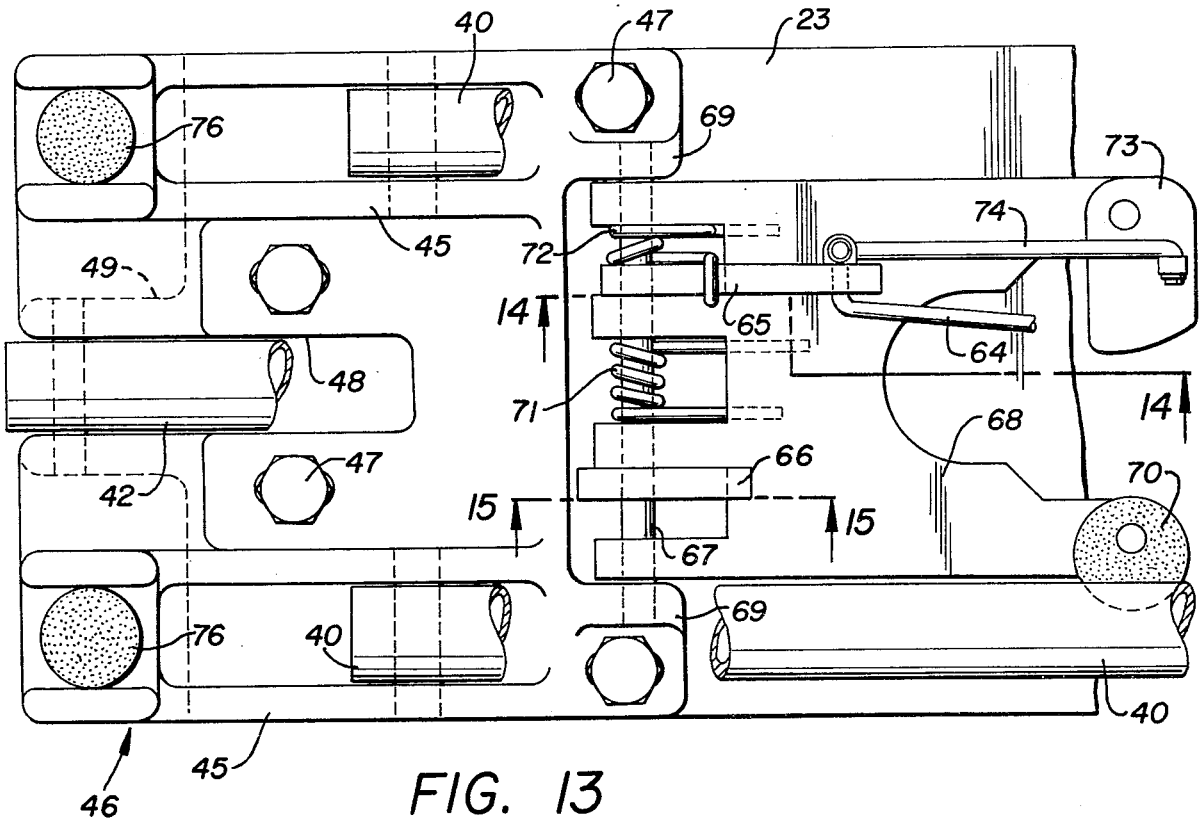
FIG. 13 is an enlarged fragmentary sectional view as on line 13—13 of FIG. 3.
Figure 14:
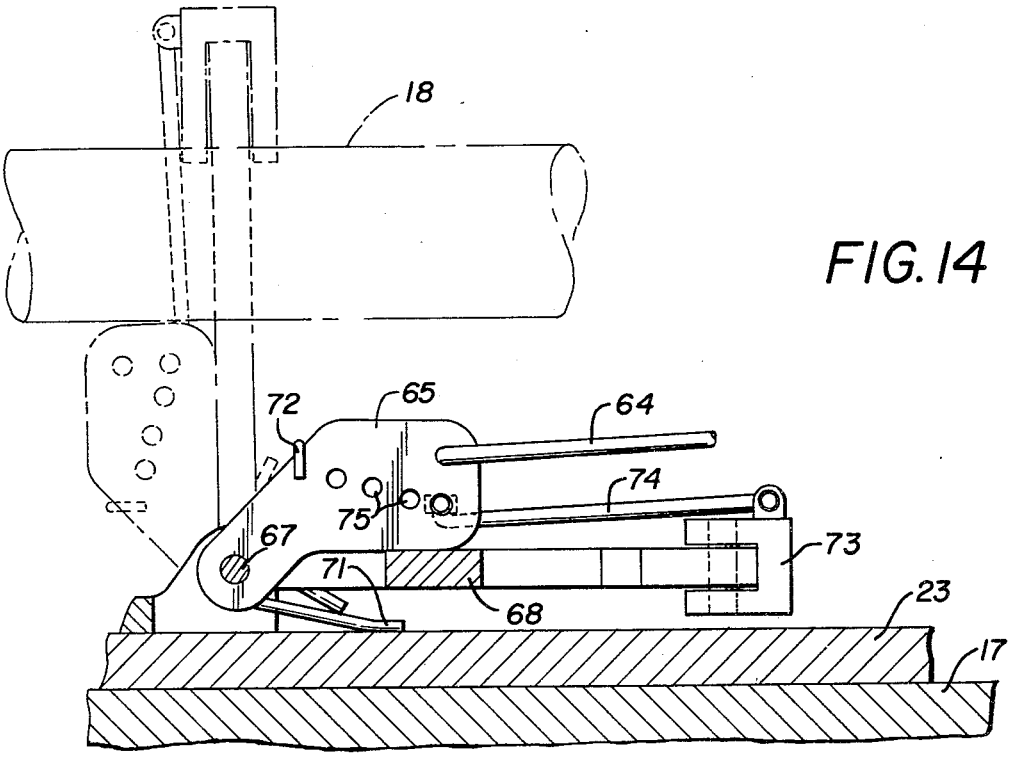
FIG. 14 is a fragmentary sectional view on line 14—14 of FIG. 13.

A catch pawl 73 is pivoted at one end on the front corner of the frame 68 laterally opposite bumper pad 70 and is pivotally connected by wire 74 to a point on the lever 65 (FIGS. 13 and 14). Several connection holes 75 are provided in catch release lever 65 for selectively connecting the wire 74 thereto, so that when the linkage is swung rearwardly to stowing position as illustrated in FIGS. 4 and 5, the motor tube 18 will engage the pawl 73 and pivot it downwardly to the position of FIG. 6 where it is yieldingly held by the action of spring 72 on lever 65 to engage the curved free end of the pawl with the tube and lock it in stowed position. The varying radius curve on the end of the pawl adapts it for engaging motor tubes of slightly varying diameter. Preferably, bumper pads 76 are provided on the upper rear surface of plate 46 to contact link bars 40 and provide a cushioned stop in the event of overtravel of the linkage when moved to stowed position. A pull on the rope 50 will release the tube by causing the catch wire assembly 62 – 64 to pivot lever 65 forwardly which in turn rotates the pawl to release the tube, when it is desired to return the motor to operating position.

Figure 5A:
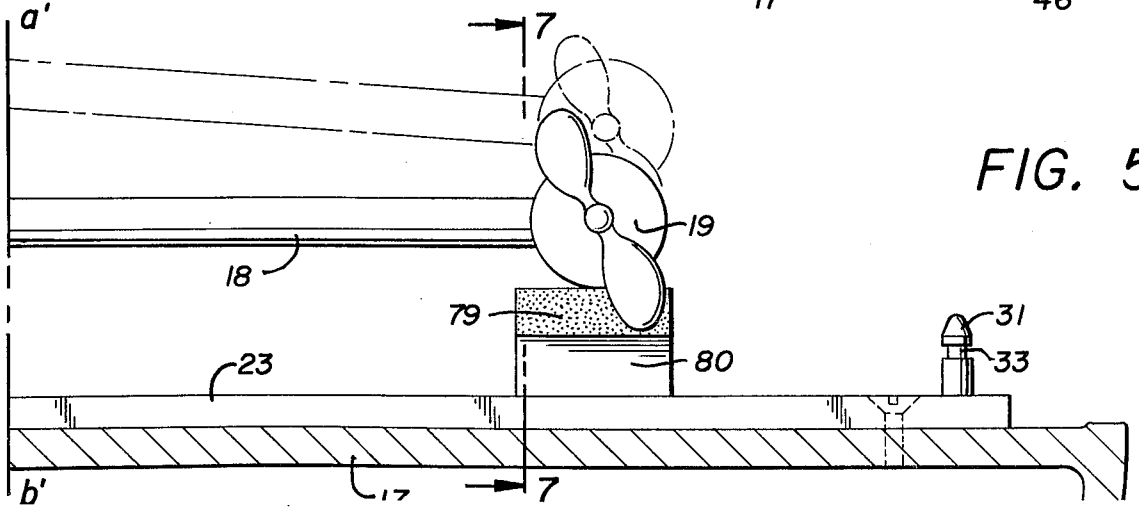
FIG. 5A is a partial side elevation completing the elevation of FIG. 5.

A U-shaped bracket 78 is secured on the base plate 23 and bumper pads 79 are provided on the ends of bracket legs 80 for supporting the motor housing 19 in the stowed position as shown in FIGS. 5A and 7. The bumper pads are located alongside of the link bars 40 in the operating position as shown in FIG. 2.

Assuming the linkage to be in the stowed position of FIGS. 5 and 5A with the motor tube 18 locked in place by pawl 73, when the fisherman desires to swing the motor to the operating position of FIGS. 1 – 3, he exerts a pull on the rope 50 sufficient to cause the wire link assembly 62 – 64 and lever 65 to release the pawl 73 from engagement with the tube 18, whereupon the tube may be swung upwardly as indicated in phantom lines in FIG. 5. Now the motor tube is swung forwardly and the linkage articulates through its motion about the stationary bracket plate 46, as shown in the intermediate position of FIG. 4, until it seats on the base plate 23 in the position of FIG. 3.

As the latch plates 34 descend over the latch pins 31, the conical top surfaces of the latch pins deflect the latch plates outwardly against the springs 38 until the plates are in position to be snapped into engagement with the annular recesses 33 in the pins to lock the yoke and motor in the operating position. Preferably, stop lugs 82 are provided on the mounting bracket 24 for abutting the front cross bar 56 of yoke 29 when the yoke is fully seated (FIG. 10) to stabilize the motor in its operating position. Adjustment screws 83 are provided in yoke 29 for abutting base plate 23 to eliminate rattle due to variance in dimensions of plates 38, pins 31, base plate 23 and yoke 29 (FIG. 11).

Whenever it is desired to return the motor to the stowed position a pull on the rope 50 releases the yoke 29 and a continued pull on the rope rotates the mounting bracket through 90° and the yoke 29 and link bars through 180° to the stowed position where it is locked in the catch frame 68 in the manner previously described.

It will be apparent that an improved bow mount construction has been provided which accomplishes the stated objects of the invention in a positive and efficient manner.

I claim:

1. Apparatus for mounting a trolling motor having a motor tube on the bow of a boat comprising, a base plate adapted to be secured to the boat deck adjacent the bow, a mounting bracket for clamping said motor tube, a linkage pivotally connected between said base plate and said mounting bracket for swinging said motor tube from a substantially vertical operating position in front of said base plate to a horizontal stowed position overlying said base plate, means for detachably securing said linkage to said base plate in said operating position, said linkage including a support member for resting on said base plate in said operating position and said securing means including a latch pin on the base plate projecting through said support member, a latch plate on said support member detachably engaging said latch pin, and movable means on said support member to release said latch plate.

2. Apparatus as described in claim 1, wherein second means are provided for detachably securing said motor tube to said base plate in said stowed position, and said movable means is adapted selectively to release said second securing means.

3. Apparatus as described in claim 2, wherein said second securing means includes a catch frame extending upright from said base plate in said stowed position, and a springbiased pawl on said catch frame detachably holds said motor tube in said stowed position.

4. Apparatus as described in claim 2, wherein a single pull rope is provided for releasing said first securing means in said operating position and said second securing means in said stowed position.

5. Apparatus as described in claim 4, wherein a wedge plate is longitudinally movable in said support member by said pull rope to move said latch plate laterally for releasing the same.

6. Apparatus as described in claim 1, wherein a wedge plate is longitudinally movable in said support member to move said latch plate laterally for releasing the same.

7. Apparatus as described in claim 1, wherein adjustable take-up screws are provided between said support member and said base plate for compensating for variance in part dimensions and preventing rattling.

8. Apparatus for mounting a trolling motor having a motor tube on the bow of a boat comprising, a base plate adapted to be secured to the boat deck adjacent the bow, a mounting bracket for clamping said motor tube, a linkage pivotally connected between said base plate and said mounting bracket for swinging said motor tube from a substantially vertical operating position in front of said base plate to a horizontal stowed position overlying said base plate, means for detachably securing said motor tube to said base plate in said stowed position, said securing means including a catch frame pivotally mounted on said base plate for extending upright from the base plate in said stowed position and parallel thereto in operating position, and a springbiased pawl on said catch frame to detachably hold said motor tube in said stowed position.

9. Apparatus as described in claim 8, wherein a pull rope is provided for releasing said pawl.

10. Apparatus as described in claim 8, wherein an additional securing means is provided for detachably securing said linkage to said base plate in said operating position, and movable means is provided on the support member selectively to release said additional securing means in said operating position and to release said pawl in said stowed position.

* * * * *